US011891889B2

(12) United States Patent
Liu et al.

(10) Patent No.: US 11,891,889 B2
(45) Date of Patent: Feb. 6, 2024

(54) CORROSION PREDICTION FOR INTEGRITY ASSESSMENT OF METAL TUBULAR STRUCTURES

(71) Applicant: Landmark Graphics Corporation, Houston, TX (US)

(72) Inventors: Zhengchun Liu, Sugar Land, TX (US); Robello Samuel, Cypress, TX (US); Adolfo Gonzales, Houston, TX (US); Yongfeng Kang, Katy, TX (US)

(73) Assignee: Landmark Graphics Corporation, Houston, TX (US)

( * ) Notice: Subject to any disclaimer, the term of this patent is extended or adjusted under 35 U.S.C. 154(b) by 182 days.

(21) Appl. No.: 17/606,228

(22) PCT Filed: May 16, 2019

(86) PCT No.: PCT/US2019/032705
§ 371 (c)(1),
(2) Date: Oct. 25, 2021

(87) PCT Pub. No.: WO2020/231442
PCT Pub. Date: Nov. 19, 2020

(65) Prior Publication Data
US 2022/0205353 A1 Jun. 30, 2022

(51) Int. Cl.
*C10G 7/10* (2006.01)
*E21B 47/00* (2012.01)

(52) U.S. Cl.
CPC ..... *E21B 47/006* (2020.05); *E21B 2200/20* (2020.05)

(58) Field of Classification Search
CPC ..... G06N 3/0436; G06N 3/084; G06N 3/086; G06N 5/003; G06N 5/048; G06N 5/045;
(Continued)

(56) References Cited

U.S. PATENT DOCUMENTS 4,752,360 A * 6/1988 Jasinski ..... G01N 17/02 205/777
4,998,208 A * 3/1991 Buhrow ..... F17D 5/00 702/34

(Continued)

OTHER PUBLICATIONS

ISRWO International Search Report and Written Opinion for PCT/US2019/032705 dated Feb. 14, 2020.

(Continued)

*Primary Examiner* — Edwin J Toledo-Duran
(74) *Attorney, Agent, or Firm* — Michael Jenney; C. Tumey Law Group PLLC

(57) ABSTRACT

A method for assessing an integrity of metal tubular structures may comprise receiving one or more inputs, applying an algorithm to automatically select an appropriate model for a given corrosion scenario, applying a combined model including semi-empirical and multiphase flow corrosion characteristics to the one or more inputs, determining one or more corrosion parameters of either an internal pipe wall, an external pipe surface, or both, applying a corrosion correlation value to the one or more corrosion parameters to produce one or more correlated corrosion parameters, and storing the one or more correlated corrosion parameters on a computer readable medium. A system may comprise an information handling system which may comprise at least one memory operable to store computer-executable instructions, at least one communications interface to access the at least one memory, and at least one processor.

20 Claims, 5 Drawing Sheets

(58) Field of Classification Search
CPC .. G06N 5/022; F17D 5/00; F17D 5/02; G05B 23/0283; C10G 7/10; E21B 47/006; E21B 2200/20; E21B 44/00
See application file for complete search history.

(56) References Cited

U.S. PATENT DOCUMENTS

| | | | | |
|---|---|---|---|---|
| 7,609,874 | B2 * | 10/2009 | Eswara | G06F 18/00 382/152 |
| 7,941,282 | B2 * | 5/2011 | Ziegel | G01B 21/08 702/170 |
| 8,447,529 | B2 * | 5/2013 | Hernandez | F17D 5/00 205/777 |
| 9,255,910 | B2 * | 2/2016 | Volker | G01N 29/04 |
| 9,274,854 | B2 * | 3/2016 | Jeyapaul | G06F 11/1479 |
| 9,297,767 | B2 * | 3/2016 | Maida, Jr. | G01N 21/7703 |
| 9,317,635 | B2 * | 4/2016 | O'Connor | B01D 53/1412 |
| 10,060,250 | B2 * | 8/2018 | Samson | E21B 47/113 |
| 10,330,587 | B2 * | 6/2019 | Kumar | G01N 17/02 |
| 11,274,049 | B2 * | 3/2022 | Salu | C10G 75/02 |
| 2008/0257782 | A1 * | 10/2008 | Vachhani | C10G 7/10 422/53 |
| 2010/0023276 | A1 * | 1/2010 | Gupta | F17D 5/06 702/34 |
| 2010/0185401 | A1 * | 7/2010 | Hernandez | F17D 5/00 702/34 |
| 2012/0279599 | A1 * | 11/2012 | Gluskin | G01N 17/00 702/58 |
| 2014/0278148 | A1 * | 9/2014 | Ziegel | F17D 5/005 702/34 |
| 2016/0076926 | A1 * | 3/2016 | McCann | G01F 1/60 73/861.04 |
| 2018/0365555 | A1 * | 12/2018 | Aslam | G06N 3/084 |
| 2020/0292441 | A1 * | 9/2020 | Gattu | G01N 17/02 |
| 2023/0034897 | A1 * | 2/2023 | Silakorn | G05B 23/0283 |

OTHER PUBLICATIONS

Adetunji, Olayide Rasaq, "Modeling and Simulation of Pipeline Corrosion in the Oil and Gas Industries," Corrosion and Materials in the Oil and Gas Industries, CRC Press Taylor and Francis Group, London, Oct. 2013, 1st Edition, pp. 375-394. pp. 382-392.

Nesic, Srdjan, "Key issues related to modelling of internal corrosion of oil and gas pipelines—A review." Corrosion Science, Jul. 14, 2007, vol. 49, Iss. 12, pp. 4308-4338. pp. 4327-4333.

EuroCorr, Smith, et al., paper No. 05648—Corrosion prediction and materials selection for oil and gas producing environments (2005).

NACE paper No. C2012-0001216—Evaluation of a CO2/H2S Corrosion Prediction Model in Multiphase Oil / Gas Production Systems (2012).

NACE paper No. 02238—CO2 Corrosion Mechanistic Modeling and Prediction in Horizontal Slug Flow (2002).

NACE paper No. 593—Optimal selection of materials for seawater injection systems testing in deoxygenated seawater (1996).

Honeywell—Predict Corrosion Suite, 2018.

EUROCORR 2001, C. de Waard, et al., Paper 59, Modelling Corrosion Rates in Oil Production Tubing.

Ohio University—MultiCorpTM, Accessed Jul. 15, 2021. Available at https://www.ohio.edu/engineering/corrosion/research/multicorp.

* cited by examiner

CORROSION PREDICTION FOR INTEGRITY ASSESSMENT OF METAL TUBULAR STRUCTURES

BACKGROUND

Corrosion has been identified by the oil and gas industry as a long-term factor that affects the strength of oilfield pipes (e.g., casing, tubing, pipeline, etc.) and may result in well integrity problems. It is one of the typical concerns for new well design, mature well workover, and abandoned well monitoring. Existing corrosion prediction techniques are focused on internal wall corrosion of pipes in oil/gas tubular structures. Typical internally-corroded examples are production tubing and transportation pipelines. However, corrosion may happen in the pipe of an injection system and at the external surface of a casing/tubing pipe. There remain aspects of these corrosion scenarios that have not been adequately addressed. A more comprehensive approach may be beneficial.

BRIEF DESCRIPTION OF THE DRAWINGS

These drawings illustrate certain aspects of some examples of the present disclosure and should not be used to limit or define the disclosure.

DETAILED DESCRIPTION

Figure 1:
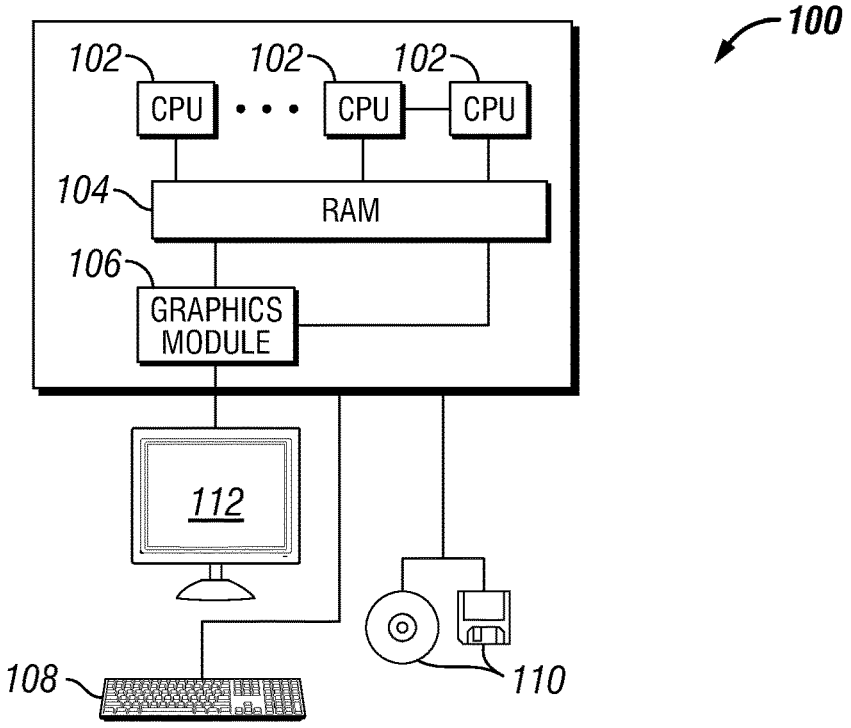
FIG. 1 illustrates an example of an information handling system.

Provided are systems and methods for corrosion prediction for assessing the integrity of metal tubular structures. As discussed below, integrated solutions of corrosion analysis are provided which may enable end-to-end, lifetime well integrity management. In other aspects of the disclosure, corrosion prediction models are integrated with thermal flow models and stress analysis models. Without limitation, the corrosion prediction package may include a model selection mechanism that may be integrated with semi-empirical models, mechanistic models, and newly-developed correlations.

Examples of the present disclosure will be described more fully hereinafter with reference to the accompanying drawings in which like numerals represent like elements throughout the several figures, and in which example embodiments are shown. Examples of the claims may, however, be embodied in many different forms and should not be construed as limited to the examples set forth herein. The examples set forth herein are non-limiting examples and are merely examples among other possible examples.

It is to be understood that the following disclosure provides many different examples for implementing different features of various methods and systems. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various examples and/or configurations discussed. Moreover, the formation of a first feature over or on a second feature in the description that follows may include examples in which the first and second features are formed in direct contact, and may also include examples in which additional features may be formed interposing the first and second features, such that the first and second features may not be in direct contact.

In the following description, numerous details are set forth to provide an understanding of the present disclosure. However, it will be understood by those of ordinary skill in the art that the present disclosure may be practiced without these details and that numerous variations or modifications from the described examples may be possible. The disclosure will now be described with reference to the figures, in which like reference numerals refer to like, but not necessarily the same or identical, elements throughout. For purposes of clarity in illustrating the characteristics of the present disclosure, proportional relationships of the elements have not necessarily been maintained in the figures.

Specific examples pertaining to the method are provided for illustration only. The arrangement of steps in the process or the components in the system described in respect to an application may be varied in further examples in response to different conditions, modes, and requirements. In such further examples, steps may be carried out in a manner involving different graphical displays, queries, analyses thereof, and responses thereto, as well as to different collections of data. Moreover, the description that follows includes exemplary apparatuses, methods, techniques, and instruction sequences that embody techniques of the disclosed subject matter. It is understood, however, that the described examples may be practiced without these specific details or employing only portions thereof.

FIG. 1 generally illustrates an example of an information handling system 100, which may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 100 may be a personal computer, a network storage device, or any other suitable device and may vary in size, shape, performance, functionality, and price. In examples, information handling system 100 may be referred to as a supercomputer or a graphics supercomputer.

As illustrated, information handling system 100 may include one or more central processing units (CPU) or processors 102. Information handling system 100 may also include a random-access memory (RAM) 104 that may be accessed by processors 102. It should be noted information handling system 100 may further include hardware or software logic, ROM, and/or any other type of nonvolatile memory. Information handling system 100 may include one or more graphics modules 106 that may access RAM 104. Graphics modules 106 may execute the functions carried out by a Graphics Processing Module (not illustrated), using hardware (such as specialized graphics processors) or a combination of hardware and software. A user input device 108 may allow a user to control and input information to information handling system 100. Additional components of the information handling system 100 may include one or more disk drives, output devices 112, such as a video display, and one or more network ports for communication with external devices as well as a user input device 108 (e.g., keyboard, mouse, etc.). Information handling system 100 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media 110 such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2:
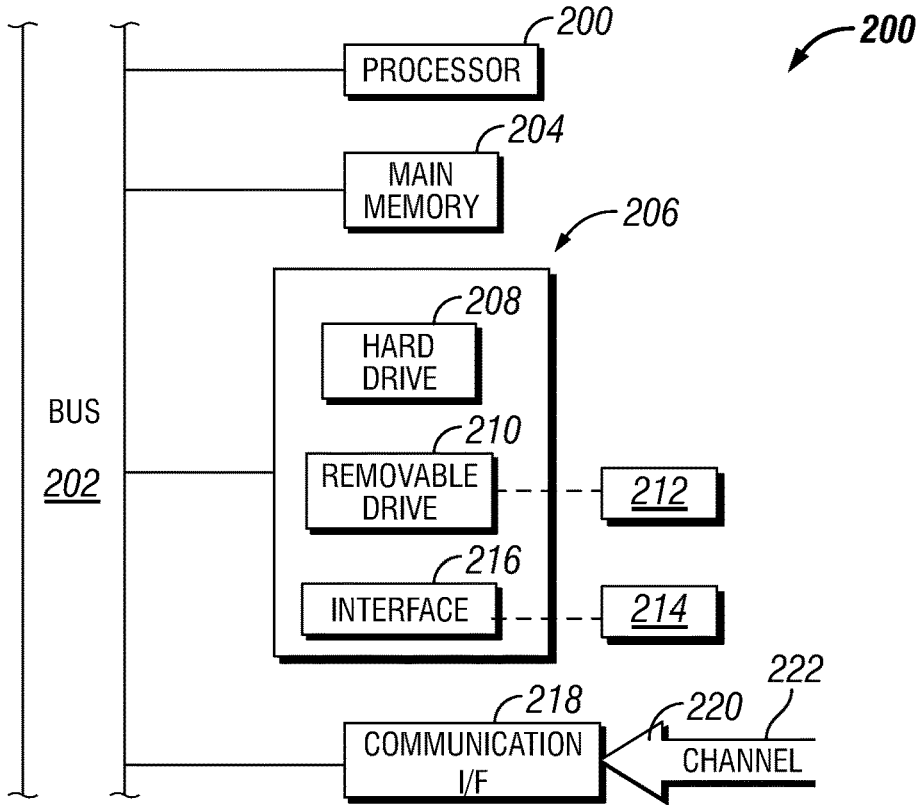
FIG. 2 illustrates another more detailed example of the information handling system.

FIG. 2 illustrates additional detail of information handling system 100. For example, information handling system 100 may include one or more processors, such as processor 200. Processor 200 may be connected to a communication interface 202. Various software examples are described in terms of this exemplary computer system. After reading this description, it will become apparent to a person skilled in the relevant art how to implement the example embodiments using other computer systems and/or computer architectures.

Information handling system 100 may also include a main memory 204, preferably random-access memory (RAM), and may also include a secondary memory 206. Secondary memory 206 may include, for example, a hard disk drive 208 and/or a removable storage drive 210, representing a floppy disk drive, a magnetic tape drive, an optical disk drive, etc. Removable storage drive 210 may read from and/or writes to a removable storage unit 212 in any suitable manner. Removable storage unit 212, represents a floppy disk, magnetic tape, optical disk, etc. which is read by and written to by removable storage drive 210. As will be appreciated, removable storage unit 212 includes a computer usable storage medium having stored therein computer software and/or data.

In alternative examples, secondary memory 206 may include other operations for allowing computer programs or other instructions to be loaded into information handling system 100. For example, a removable storage unit 214 and an interface 216. Examples of such may include a program cartridge and cartridge interface (such as that found in video game devices), a removable memory chip (such as an EPROM, or PROM) and associated socket, and other removable storage units 214 and interfaces 216 which may allow software and data to be transferred from removable storage unit 214 to information handling system 100.

In examples, information handling system 100 may also include a communications interface 218. Communications interface 218 may allow software and data to be transferred between information handling system 100 and external devices. Examples of communications interface 218 may include a modem, a network interface (such as an Ethernet card), a communications port, a PCMCIA slot and card, etc. Software and data transferred via communications interface 218 are in the form of signals 220 that may be electronic, electromagnetic, optical or other signals capable of being received by communications interface 218. Signals 220 may be provided to communications interface via a channel 222. Channel 222 carries signals 220 and may be implemented using wire or cable, fiber optics, a phone line, a cellular phone link, an RF link and/or any other suitable communications channels. For example, information handling system 100 includes at least one memory 204 operable to store computer-executable instructions, at least one communications interface 202, 218 to access the at least one memory 204; and at least one processor 200 configured to access the at least one memory 204 via the at least one communications interface 202, 218 and execute computer-executable instructions.

In this document, the terms "computer program medium" and "computer usable medium" are used to generally refer to media such as removable storage unit 212, a hard disk installed in hard disk drive 208, and signals 220. These computer program products may provide software to information handling system 100.

Computer programs (also called computer control logic) may be stored in main memory 204 and/or secondary memory 206. Computer programs may also be received via communications interface 218. Such computer programs, when executed, enable information handling system 100 to perform the features of the example embodiments as discussed herein. In particular, the computer programs, when executed, enable processor 200 to perform the features of the example embodiments. Accordingly, such computer programs represent controllers of information handling system 100.

In examples with software implementation, the software may be stored in a computer program product and loaded into information handling system 100 using removable storage drive 210, hard disk drive 208 or communications interface 218. The control logic (software), when executed by processor 200, causes processor 200 to perform the functions of the examples as described herein.

In examples with hardware implementation, hardware components such as application specific integrated circuits (ASICs). Implementation of such a hardware state machine so as to perform the functions described herein will be apparent to persons skilled in the relevant art(s). It should be noted that the disclosure may be implemented at least partially on both hardware and software.

Figure 3:
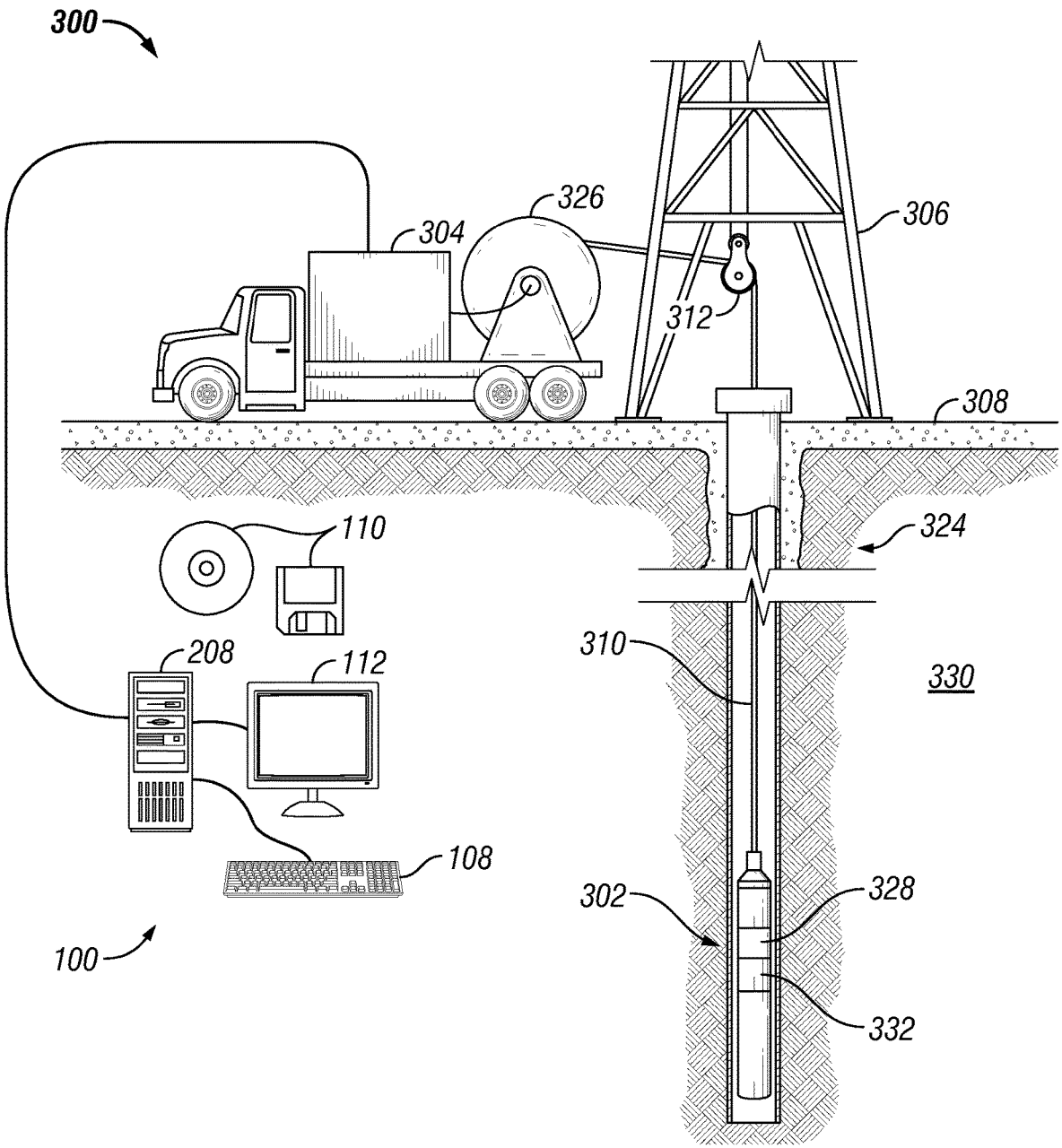
FIG. 3 illustrates a cross-sectional view of a well measurement system.

FIG. 3 illustrates a cross-sectional view of a well measurement system 300. As illustrated, a well measurement system 300 may comprise downhole tool 302 attached to a vehicle 304. In examples, it should be noted that downhole tool 302 may not be attached to a vehicle 304. Downhole tool 302 may be supported by rig 306 at surface 308. Downhole tool 302 may be tethered to vehicle 304 through conveyance 310. Conveyance 310 may be disposed around one or more sheave wheels 312 to vehicle 304. Conveyance 310 may include any suitable means for providing mechanical conveyance for downhole tool 302, including, but not limited to, wireline, slickline, coiled tubing, pipe, drill pipe, downhole tractor, or the like. In examples, conveyance 310 may provide mechanical suspension, as well as electrical connectivity, for downhole tool 302. Conveyance 310 may comprise, in some instances, a plurality of electrical conductors extending from vehicle 304. Conveyance 310 may comprise an inner core of seven electrical conductors covered by an insulating wrap. An inner and outer steel armor sheath may be wrapped in a helix in opposite directions around the conductors. The electrical conductors may be used for communicating power and telemetry between vehicle 304 and downhole tool 302.

Information from downhole tool 302 may be gathered and/or processed by information handling system 100. For example, signals recorded by downhole tool 302 may also be stored on memory and then processed by downhole tool 302. The processing may be performed in real-time during data acquisition or after recovery of downhole tool 302. Processing may alternatively occur downhole or may occur both downhole and at the surface. In examples, signals recorded by downhole tool 302 may be conducted to information handling system 100 by way of conveyance 310. Information handling system 100 may process the signals, and the information contained therein may be displayed for an operator to observe and stored for future processing and reference. Information handling system 100 may also contain an apparatus for supplying control signals and power to downhole tool 302.

Systems and methods of the present disclosure may be implemented, at least in part, with information handling system 100. Information handling system 100 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 100 may be a processing unit with hard disk drive 208, a network storage device, or any other suitable device and may vary in size, shape, performance, functionality, and price. Information handling system 100 may include random access memory (RAM), one or more processing resources such as a central processing unit (CPU) or hardware or software control logic, ROM, and/or other types of nonvolatile memory. Additional components of the information handling system 100 may include one or more disk drives, one or more network ports for communication with external devices as well as various input and output (I/O) devices, such as an input device 108 (e.g., keyboard, mouse, etc.) and an output device 112. Information handling system 100 may also include one or more buses operable to transmit communications between the various hardware components.

Alternatively, systems and methods of the present disclosure may be implemented, at least in part, with non-transitory computer-readable media 322. Non-transitory computer-readable media 322 may include any instrumentality or aggregation of instrumentalities that may retain data and/or instructions for a period of time. Non-transitory computer-readable media 322 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

In examples, rig 306 includes a load cell (not shown) which may determine the amount of pull on conveyance 310 at the surface of borehole 324. Information handling system 100 may comprise a safety valve which controls the hydraulic pressure that drives drum 326 on vehicle 304 which may reel up and/or release conveyance 310 which may move downhole tool 302 up and/or down borehole 324. The safety valve may be adjusted to a pressure such that drum 326 may only impart a small amount of tension to conveyance 310 over and above the tension necessary to retrieve conveyance 310 and/or downhole tool 302 from borehole 324. The safety valve is typically set a few hundred pounds above the amount of desired safe pull on conveyance 310 such that once that limit is exceeded; further pull on conveyance 310 may be prevented.

Downhole tool 302 may comprise a transmitter 328. In examples, downhole tool 302 may operate with additional equipment (not illustrated) on surface 308 and/or disposed in a separate well measurement system (not illustrated) to record measurements and/or values from formation 330. During operations, transmitter 328 may broadcast a signal from downhole tool 302. Transmitter 328 may be connected to information handling system 100, which may further control the operation of transmitter 328. For example, the broadcasted signal from transmitter 328 may be reflected by formation 330. The reflected signal may be transferred to information handling system 100 for further processing. In examples, there may be any suitable number of transmitters 328, which may be controlled by information handling system 100. Information and/or measurements may be processed further by information handling system 100 to determine properties of borehole 324, fluids, and/or formation 330. Reflected signals may be captured by one or more receivers 332.

Figure 4:
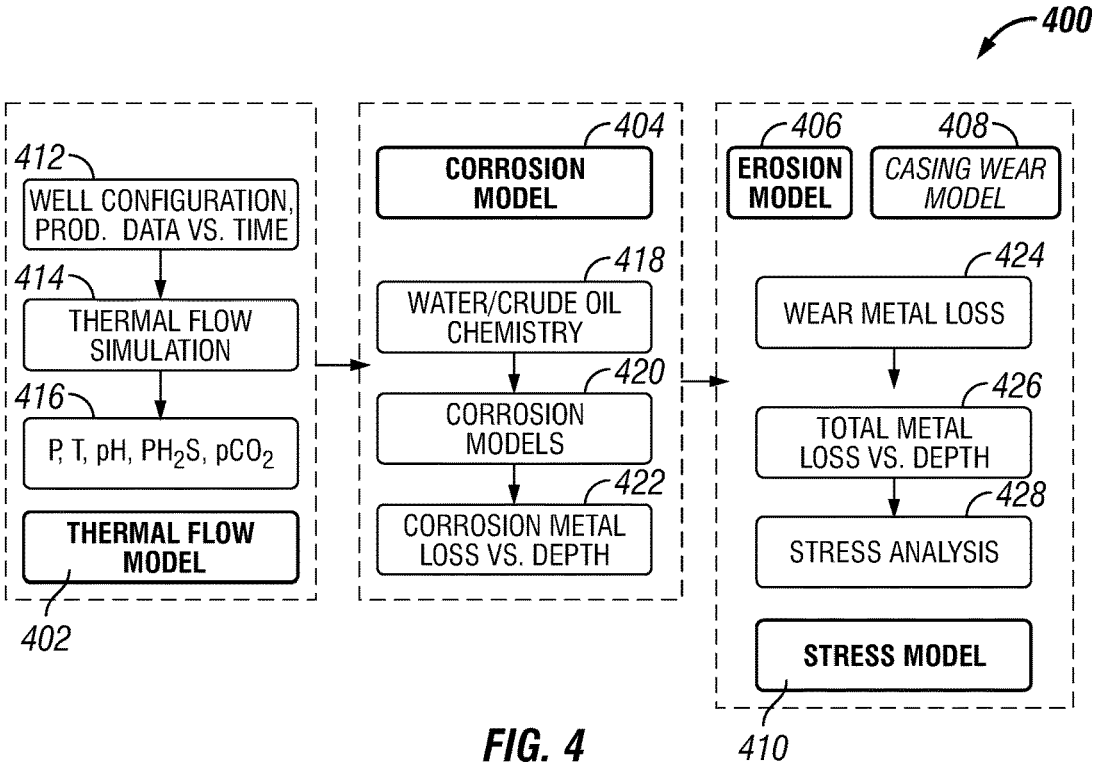
FIG. 4 illustrates an integrated model approach for the prediction of metal component corrosion.

FIG. 4 illustrates aspects of a corrosion prediction model 400 for the prediction of metal component corrosion. As shown corrosion prediction model 400 may include thermal flow model 402, corrosion model 404, erosion model 406, casing wear model 408, and stress analysis model 410. As illustrated, thermal flow model 402 may begin with block 412, which includes well configuration data and production data over time. Well configuration data may be sourced from previous drilling operations and/or logging tools during logging operations. Additionally, production data over time may be produced from measurements taken over the life of the well and stored for further reference. Characteristics, parameters, and/or measurements from block 412 may be put into a thermal flow simulation in block 414. Thermal flow simulation in block 414 may determine and display the transfer of heat across any structure (i.e., casings and/or the like) that may be downhole. This simulation may utilize production information related to pressure, temperature, potential hydrogen, partial pressure of $H_2S$, and partial pressure of $CO_2$ (which may be identified as P, T, pH, $pH_2S$, and $pCO_2$) during the simulation. Without limitation, other variable and information may be obtained from thermal flow simulation in block 414. Output from thermal flow model 402, information in block 416, may be supplied to corrosion model 404.

Corrosion model 404 may include block 418 (water/crude oil chemistry), block 420 (corrosion models), and block 422 (corrosion metal loss vs. depth). As illustrated, block 418 may include information detailing water/crude oil chemistry. Information may relate to the percentage of water and crude oil within a wellbore. Without limitation, additional information may include types of crude oil and types of hydrocarbons within a wellbore. This information may be placed as in input into corrosion models in block 420. Corrosion models may process the data from block 418 to determine where corrosion may be within a wellbore, and specifically how the corrosion may affect downhole structures such as casing, tubing, and/or the like. Corrosion information from block 420 may be transformed into a corrosion metal loss vs. depth graph in block 422. This may lay out a display that may allow quick reference for determining where in a wellbore corrosion may be located.

Output from corrosion model 404 is provided to stress analysis model 410. Stress model 510 may include an erosion model 406, casing wear model 408, metal wear loss in block 424, block 426 (total metal loss vs. depth), and stress analysis in block 428. As illustrated, information from corrosion model 404 is fed into stress analysis model 410 as block 426 that may include graphs and information for total metal loss vs depth. Block 426 may also include information from block 424, which may include wear metal loss information that may be found from erosion model 406 and casing wear model 408. The output from block 426 may produce a stress analysis in block 428, which may show stress across structures within a wellbore, such as stress across casings, tubulars, and/or the like.

According to a further aspect of the present disclosure, a corrosion prediction system may include a model selection mechanism that is integrated with semi-empirical models, mechanistic models, and newly-developed correlations. A corresponding software implemented tool for corrosion analysis may be used to predict pipe metal losses (e.g., thickness reduction) and consequently pipe strength changes, caused by corrosion over time. Additional examples of the present disclosure include integration with thermal flow models 402 and stress analysis models 410, scenario-specific selection of corrosion models, e.g., semi-empirical model for production and mechanistic model for injection, a corrosion model for pipe external corrosion, and a corrosion-resistance model of steel Cr-content. It will be appreciated by one of ordinary skill in the art that aspects of the present disclosure may be implemented in a variety of ways, including as a standalone module, an API, or as part of a larger system to provide a system for the determination of a corrosion rate (or metal loss) prediction.

The illustrated corrosion prediction model 400 shows that a thermal flow model 402 and semi-empirical model are coupled along with integration of a mechanistic corrosion model with multiphase flow model. Additionally, it will be appreciated that $CO_2$ semi-empirical models may be effective for oil-filed production/transportation systems. Integration including the semi-empirical corrosion model with the multiphase flow model and further coupled with stress model in accordance with the present disclosure is generally shown in FIG. 4. Since corrosion may be a factor of tubular wall thickness reduction, integration of one or more corrosion models 400 may enable a more comprehensive stress analysis to be performed. As shown, corrosion, mechanical wear, erosion, etc. are all factors included in the calculation of pipe stress and strength.

According to some examples, an algorithm is employed to select an appropriate model for a particular corrosion scenario. For example, for internal corrosion of production tubing, a semi-empirical $CO_2/H_2S$ corrosion model may be selected. In the case of internal corrosion of water-injection tubing, a mechanistic $O_2/H_2S$ corrosion model may be selected. This scenario-tailored approach not only offers combined model capabilities, but also generates more accurate results.

Figure 5:
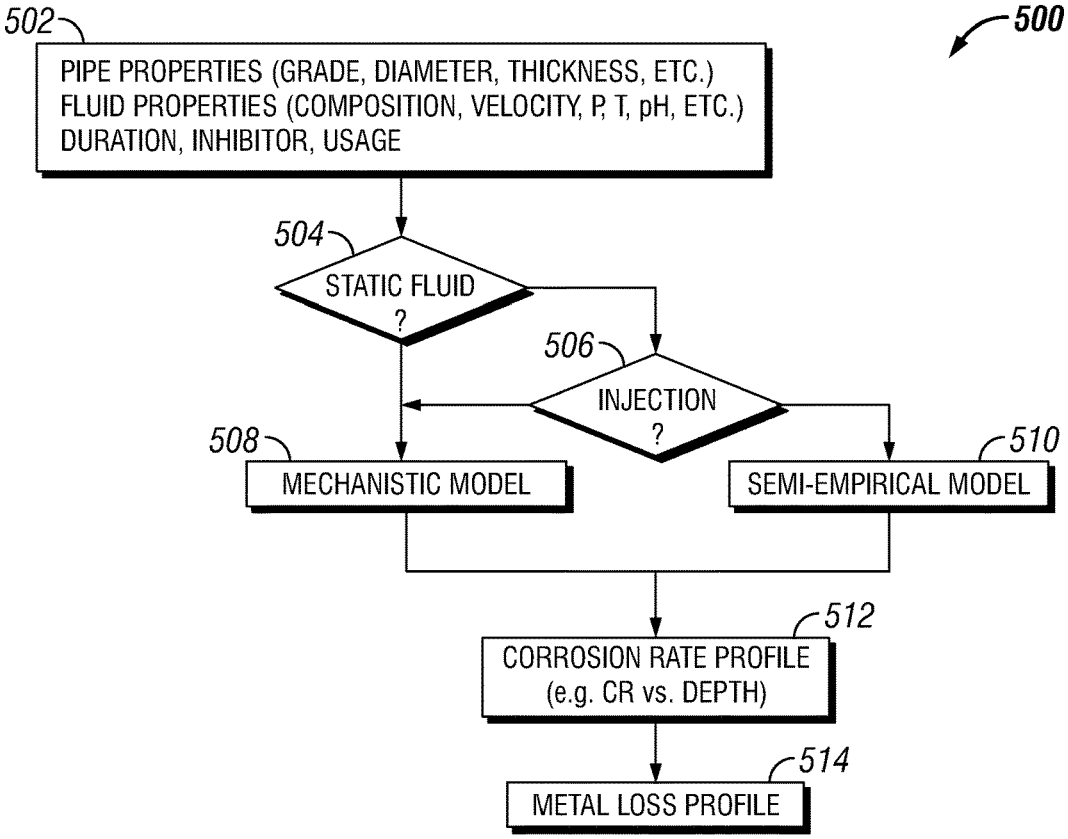
FIG. 5 illustrates a workflow for determining a metal loss profile.

FIG. 5 illustrates a workflow 500 for determining an external pipe corrosion according to one or more examples of the present disclosure. In FIG. 5, workflow 500 may be processed by information handling system 100 (e.g., referring to FIGS. 1 and 2) to determine and provide an integrity assessment. It should be noted that workflow 500 may be implemented by information handling system 100 as either software which may be disposed on main memory 204 or secondary memory 206 (e.g., referring to FIG. 2). As illustrated in FIG. 5, workflow 500 may begin with block 502, wherein a number of inputs are received including pipe properties, fluid properties, duration, and whether or not corrosion inhibitors have been used. It will be appreciated that pipe properties may include grade, diameter, thickness, and the like. Additionally, fluid properties may include composition, velocity, P, T, pH, and the like, as discussed above).

After block 502, in block 504 a determination is made whether or not the environment includes static fluid. In examples, a static fluid may be measured by a downhole tool or sensors. Without limitation, static fluid may refer to the movement of fluids between casing, cement, and the formation. If there are is not static fluid, then workflow 500 skips to block 508, discussed below. If the fluid is static, then workflow 500 moves to block 506. In block 506, a determination is made whether or not the environment includes an injection component. An injection component may refer to substances, operations, and/or the like that may be disposed into fluids outside of the casing, cement, and the formation that may affect corrosion on the outer surface of the casing or cement. If there is an injection, workflow may move to block 508. If there is not an injection, the workflow may move to block 510. Blocks 504 and 506 may lead to the selection of mechanistic model of block 508. Block 510 may lead to the selection of a semi-empirical model. After application of mechanistic model of block 508, semi-empirical model of block 510, or a combination thereof, block 512 provides a corrosion rate profile which may include a corrosion rate vs. depth, or some combination. Block 514 follows in which a metal loss profile is provided from the data of block 512.

According to one example use of workflow 500, a selection algorithm is employed to select appropriate corrosion model for a particular corrosion scenario. For example, for internal corrosion of production tubing, a semi-empirical $CO_2/H_2S$ corrosion model may be selected. By way of another example, for internal corrosion of water-injection tubing, a mechanistic $O_2/H_2S$ corrosion model may be selected. It will be appreciated that aspects of this scenario-tailored approach offer a combined model capability in addition to generates increasingly accurate results.

It will be appreciated that techniques are focused on internal wall corrosion of pipes in oil/gas tubular structures. These may typically be exemplified by internally-corroded examples such as production tubing and transportation pipelines. However, it will be appreciated that corrosion may happen at the external surface of a pipe. Accordingly, these corrosion scenarios are addressed by the present disclosure in which, by way of example, a mechanistic corrosion model modified in accordance with the present disclosure may handle such kinds of scenarios. By way of another example, in accordance with the present disclosure, even at zero fluid velocity, the diffusion-controlled corrosion rate may be still calculated.

The present disclosure provides for modeling the effect of Cr content. It will further be appreciated that corrosion processes may be complex in terms of chemical and electrochemical reactions. It may be difficult to accurately model the effect of even one single parameter, for example, the Cr content in piping material such as steel. However, based in part on research and testing, a correlation was developed to include the effect of Cr content in the pipe material.

$$CR_{adj2}=F_{Cr}*CR \quad (1)$$

where $F_{Cr}$ is the Cr content factor.

$$F_{Cr}=c*\exp(-d*Cr\%) \quad (2)$$

where c and d are model constants obtained by regression. It may be noted that certain approaches employ semi-empirical models for production and employ a mechanistic model for injection scenarios. Aspects of the present disclosure permit additional flexibility. For example, according the present disclosure, it is possible to choose mechanistic (or semi-empirical) models for both production and injection. According to another example of the present disclosure, it is also possible to choose mechanistic model for production and semi-empirical model for injection. Yet another example of the disclosure provides for the selection of data-driven models and/or physics-based models for the aforementioned corrosion prediction.

Figure 6A:
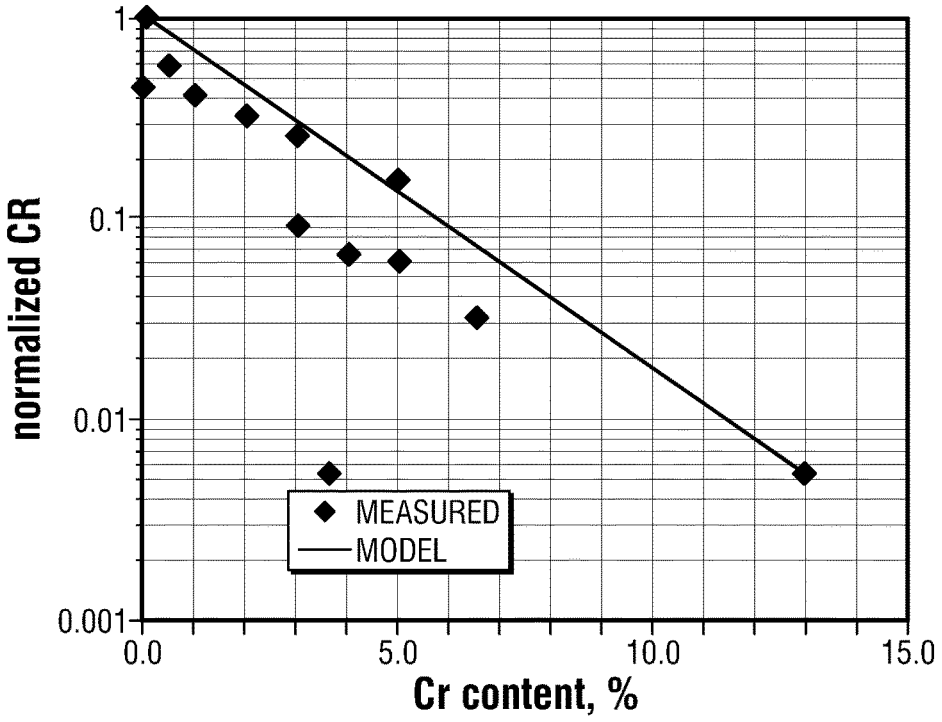
FIG. 6A illustrates predicted and experimentally-measured $CO_2$ corrosion rate for pipes with different Cr content.
Figure 6B:
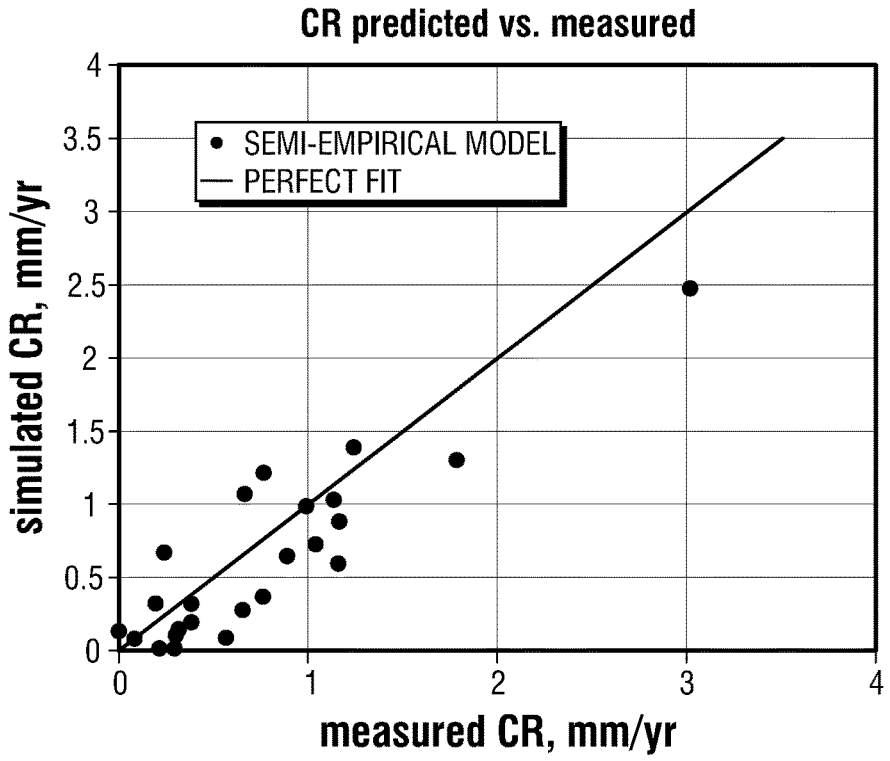
FIG. 6B illustrates field-observed $CO_2$ corrosion rate vs. predicted corrosion rate based on corrosion modeling.
Figure 7:
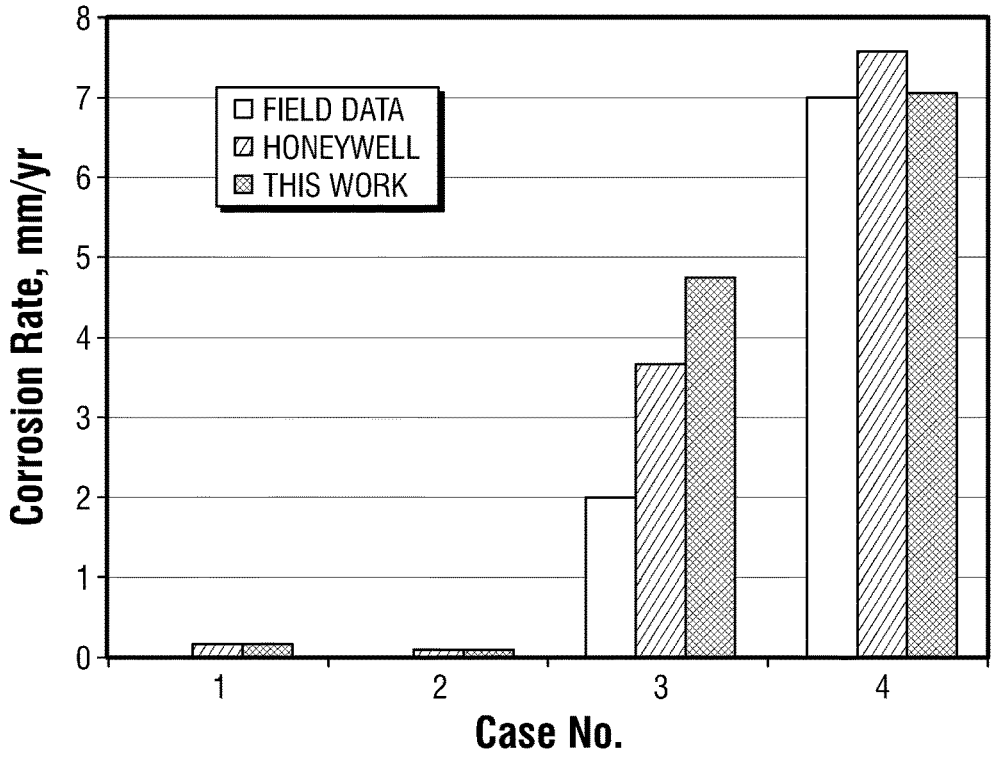
FIG. 7 illustrates predicted $CO_2/H_2S$ corrosion rates vs. measured field data of oil/gas production wells.

FIG. 6A illustrates predicted and experimentally-measured $CO_2$ corrosion rate for pipes with different Cr content, using the workflows discussed above. The results disposed in FIG. 6A are compared to actual measured results in FIG. 6B. FIG. 6B illustrates field-observed $CO_2$ corrosion rate vs. predicted corrosion rate based on measured data from corrosion and corrosion modeling. As seen, FIG. 6B affirms the predictions seen in FIG. 6A FIG. 7 illustrates predicted $CO_2/H_2S$ corrosion rates vs. measured field data of oil/gas production wells from currently active wells. These measured wells come from different sources and measure the corrosion rate over one to four cases.

Figure 8:
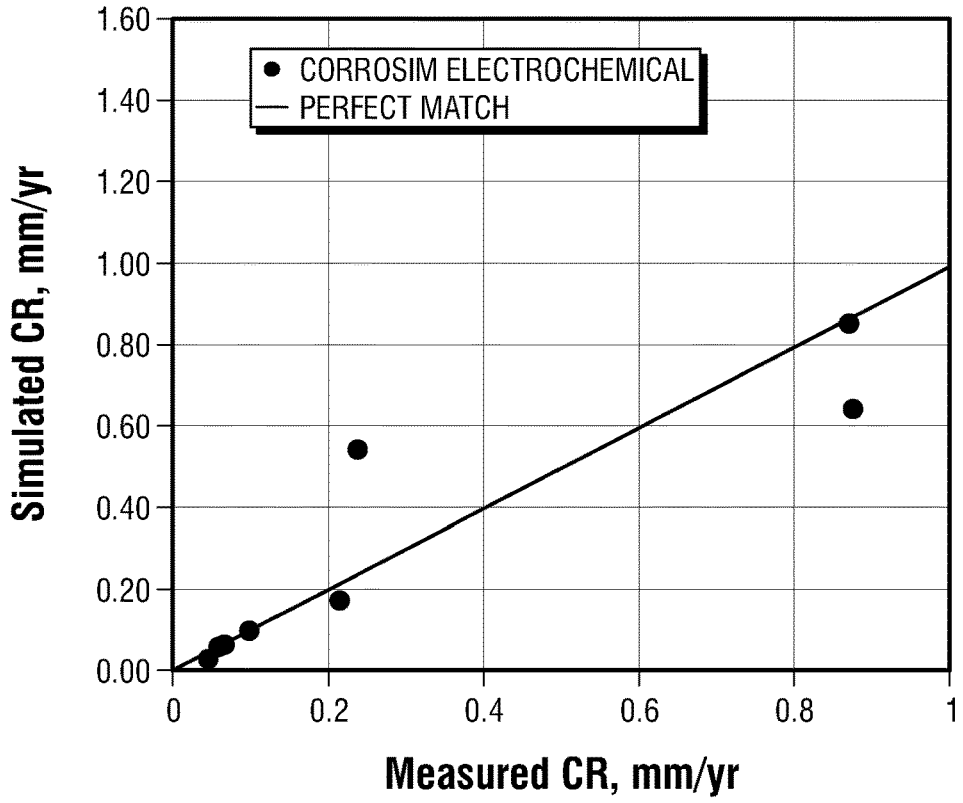
FIG. 8 illustrates predicted $O_2$ corrosion rate vs. experimental data of water injection.

FIG. 8 illustrates predicted $O_2$ corrosion rate vs. experimental data of water injection, using the workflows discussed above. FIG. 8 affirms the data measured and graphed in FIG. 7. FIGS. 6A through 8 illustrate that workflows 400 and 500 are reliable and are proven from measured results taken in the field.

The preceding description provides various examples of the systems and methods of use disclosed herein which may contain different method steps and alternative combinations of components. Among other things, improvements over current technology include novel corrosion prediction for integrity assessment of metal tubular structures.

Statement 1. A method for assessing an integrity of metal tubular structures may comprise receiving one or more inputs; applying an algorithm to automatically select an appropriate model for a given corrosion scenario; applying a combined model including semi-empirical and multiphase flow corrosion characteristics to the one or more inputs; determining one or more corrosion parameters of either an internal pipe wall, an external pipe surface, or both; applying a corrosion correlation value to the one or more corrosion parameters to produce one or more correlated corrosion parameters; and storing the one or more correlated corrosion parameters on a computer readable medium.

Statement 2. The method of statement 1, wherein the step of applying an algorithm to automatically select an appropriate model for a given corrosion scenario selects a mechanistic $O_2/H_2S$ corrosion model for internal corrosion of water-injection tubing.

Statement 3. The method of statements 1 or 2, wherein the step of applying an algorithm to automatically select an appropriate model for a given corrosion scenario selects a semi-empirical $CO_2/H_2S$ corrosion model for internal corrosion of production tubing.

Statement 4. The method of statements 1-3, wherein the step of applying an algorithm to automatically select an appropriate model for a given corrosion scenario is based on the one or more inputs.

Statement 5. The method of statement 4, wherein the one or more inputs comprises pipe properties.

Statement 6. The method of statement 4, wherein the one or more inputs comprises fluid properties.

Statement 7. The method of statement 4, wherein the one or more inputs comprises inhibitor usage information properties.

Statement 8. A method of manufacturing an integrity assessment data product, the method may comprise receiving one or more inputs; applying a combined model including semi-empirical and multiphase flow corrosion characteristics to the one or more inputs; applying an algorithm to select an appropriate model for a given corrosion scenario; determining one or more corrosion parameters of either an internal pipe wall or an external pipe surface; applying a corrosion correlation value to the one or more corrosion parameters to produce one or more correlated corrosion parameters; and recording the one or more correlated corrosion parameters on one or more tangible, non-volatile computer-readable media thereby creating the integrity assessment data product.

Statement 9. The method of statement 8 wherein the step of applying an algorithm to select an appropriate model for a given corrosion scenario is based on the one or more inputs.

Statement 10. The method of statement 8 or 9, wherein the step of applying an algorithm to select an appropriate model for a given corrosion scenario selects a semi-empirical $CO_2/H_2S$ corrosion model for internal corrosion of production tubing.

Statement 11. The method of statements 8-10, wherein the one or more inputs comprises pipe properties.

Statement 12. The method of statement 8-11, wherein the one or more inputs comprises fluid properties.

Statement 13. The method of statement 8-12, wherein the one or more inputs comprises inhibitor usage information properties.

Statement 14. A system for assessing an integrity of metal tubular structures may comprise an information handling system which may comprise at least one memory operable to store computer-executable instructions; at least one communications interface to access the at least one memory; and at least one processor configured to access the at least one memory via the at least one communications interface and execute the computer-executable instructions to: receive one or more inputs; apply a combined model including semi-empirical and multiphase flow corrosion characteristics to the one or more inputs; apply an algorithm to automatically select an appropriate model for a given corrosion scenario; determine a corrosion parameter of either an internal pipe wall or an external pipe surface; apply a corrosion correlation value to the corrosion parameter to produce a correlated corrosion parameter; and store the correlated corrosion parameter on a computer readable medium.

Statement 15. The system of statement 14, wherein the computer-executable instructions to apply an algorithm to automatically select an appropriate model for a given corrosion scenario selects a mechanistic $O_2/H_2S$ corrosion model for internal corrosion of water-injection tubing.

Statement 16. The system of statements 14 or 15, wherein the computer-executable instructions to apply an algorithm to automatically select an appropriate model for a given corrosion scenario selects a semi-empirical $CO_2/H_2S$ corrosion model for internal corrosion of production tubing.

Statement 17. The system of statements 14-16, wherein the one or more inputs comprises pipe properties.

Statement 18. The system of statements 14-17, wherein the one or more inputs comprises fluid properties.

Statement 19. The system of statements 14-18, wherein the one or more inputs comprises inhibitor usage information properties.

Statement 20. The system of statements 14-19, wherein the computer-executable instructions to apply an algorithm to automatically select an appropriate model for a given corrosion scenario is based on the one or more inputs.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a–b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for assessing an integrity of metal tubular structures comprising:

Receiving one or more inputs;

Applying an algorithm to automatically select an appropriate model for a given corrosion scenario;

Applying a combined model including semi-empirical and multiphase flow corrosion characteristics to the one or more inputs based at least on an injection component;

Determining one or more corrosion parameters of either an internal pipe wall, an external pipe surface, or both;

Applying a corrosion correlation value to the one or more corrosion parameters to produce one or more correlated corrosion parameters; and storing the one or more correlated corrosion parameters on a computer readable medium.

2. The method of claim 1, wherein the step of applying an algorithm to automatically select an appropriate model for a given corrosion scenario selects a mechanistic $O_2/H_2S$ corrosion model for internal corrosion of water-injection tubing.

3. The method of claim 1, wherein the step of applying an algorithm to automatically select an appropriate model for a given corrosion scenario selects a semi-empirical $CO_2/H_2S$ corrosion model for internal corrosion of production tubing.

4. The method of claim 1, wherein the step of applying an algorithm to automatically select an appropriate model for a given corrosion scenario is based on the one or more inputs.

5. The method of claim 4, wherein the one or more inputs comprises pipe properties.

6. The method of claim 4, wherein the one or more inputs comprises fluid properties.

7. The method of claim 4, wherein the one or more inputs comprises inhibitor usage information properties.

8. A method of manufacturing an integrity assessment data product, the method comprising:

Receiving one or more inputs;

Applying a combined model including semi-empirical and multiphase flow corrosion characteristics to the one or more inputs based at least on an injection component;

Applying an algorithm to select an appropriate model for a given corrosion scenario;

Determining one or more corrosion parameters of either an internal pipe wall or an external pipe surface;

Applying a corrosion correlation value to the one or more corrosion parameters to produce one or more correlated corrosion parameters; and Recording the one or more correlated corrosion parameters on one or more tangible, non-volatile computer-readable media thereby creating the integrity assessment data product.

9. The method of claim 8, wherein the step of applying an algorithm to select an appropriate model for a given corrosion scenario is based on the one or more inputs.

10. The method of claim 8, wherein the step of applying an algorithm to select an appropriate model for a given corrosion scenario selects a semi-empirical $CO_2/H_2S$ corrosion model for internal corrosion of production tubing.

11. The method of claim 8, wherein the one or more inputs comprises pipe properties.

12. The method of claim 8, wherein the one or more inputs comprises fluid properties.

13. The method of claim 8, wherein the one or more inputs comprises inhibitor usage information properties.

14. A system for assessing an integrity of metal tubular structures comprising:

An information handling system comprising:

At least one memory operable to store computer-executable instructions;

At least one communications interface to access the at least one memory; and

At least one processor configured to access the at least one memory via the at least one communications interface and execute the computer-executable instructions to:

Receive one or more inputs;

Apply a combined model including semi-empirical and multiphase flow corrosion characteristics to the one or more inputs based at least on an injection component;

Apply an algorithm to automatically select an appropriate model fora given corrosion scenario;

Determine a corrosion parameter of either an internal pipe wall or an external pipe surface;

Apply a corrosion correlation value to the corrosion parameter to produce a correlated corrosion parameter; and Store the correlated corrosion parameter on a computer readable medium.

15. The system of claim 14, wherein the computer-executable instructions to apply an algorithm to automatically select an appropriate model for a given corrosion scenario selects a mechanistic $O_2/H_2S$ corrosion model for internal corrosion of water-injection tubing.

16. The system of claim 14, wherein the computer-executable instructions to apply an algorithm to automatically select an appropriate model for a given corrosion scenario selects a semi-empirical $CO_2/H_2S$ corrosion model for internal corrosion of production tubing.

17. The system of claim 14, wherein the one or more inputs comprises pipe properties.

18. The system of claim 14, wherein the one or more inputs comprises fluid properties.

19. The system of claim 14, wherein the one or more inputs comprises inhibitor usage information properties.

20. The system of claim 14, wherein the computer-executable instructions to apply an algorithm to automatically select an appropriate model for a given corrosion scenario is based on the one or more inputs.

* * * * *